US007650990B2

(12) United States Patent
Tan

(10) Patent No.: US 7,650,990 B2
(45) Date of Patent: Jan. 26, 2010

(54) GOLF BAG

(76) Inventor: Fuhsing Tan, Zao Er Industrial District, Wentang Town, Dongchen Section, Dongguan City, Guangdong Province (CN) 523000

( * ) Notice: Subject to any disclaimer, the term of this patent is extended or adjusted under 35 U.S.C. 154(b) by 233 days.

(21) Appl. No.: 10/784,162

(22) Filed: Feb. 24, 2004

(65) Prior Publication Data

US 2005/0045504 A1 Mar. 3, 2005

(30) Foreign Application Priority Data

Sep. 1, 2003 (CN) ..... 03 2 73980 U

(51) Int. Cl.
*A63B 55/04* (2006.01)

(52) U.S. Cl. ..... 206/315.7; 248/96

(58) Field of Classification Search .... 206/315.2–315.8
See application file for complete search history.

(56) References Cited

U.S. PATENT DOCUMENTS 1,467,756 A * 9/1923 Coughlin ..... 81/103
2,288,120 A * 6/1942 Challis ..... 323/355
4,053,169 A * 10/1977 Taylor ..... 280/37
5,415,285 A * 5/1995 Reimers ..... 206/315.7
5,505,300 A * 4/1996 Joh ..... 206/315.6
5,597,144 A * 1/1997 Lee ..... 248/96
5,823,485 A * 10/1998 Park ..... 248/96
6,390,295 B2 * 5/2002 Rhee ..... 206/315.7
2005/0092631 A1 * 5/2005 Campbell et al. ..... 206/315.7
2006/0006086 A1 * 1/2006 Fair et al. ..... 206/315.7

FOREIGN PATENT DOCUMENTS

JP 08057091 A * 3/1996

* cited by examiner

*Primary Examiner*—Tri M Mai
(74) *Attorney, Agent, or Firm*—Pro-Techtor Int'l Services; Ralph Willgohs

(57) ABSTRACT

A golf bag comprising a bag body, a support bracket and a tilting device. The bag body includes a top frame, a middle frame, a bottom frame, a plurality of support rod provided between the top frame and the middle frame and a joint block for stably coupling the middle frame and the bottom frame. The tilting device includes a fixed leg and a pair of steel wires extending therefrom. The fixed leg has a moveable shank therein, and a notch is formed in an inner side of the moveable shank. The moveable shank also has a support foot in a bottom thereof which can push the moveable shank to move up and down relative to the fixed leg. The middle frame has a Σ-shaped frame which can disengage with the notch by the push of the moveable shank.

7 Claims, 3 Drawing Sheets

GOLF BAG

FIELD OF THE INVENTION

The present invention is related to an assistant apparatus for golf game, and more particularly to golf bags.

BACKGROUND OF THE INVENTION

At present, golf game is very popular in the whole world, accordingly, golf equipments have been developed quickly in the last few years. More and more attention has also been paid to golf bags which are used to retain various golf equipments.

A conventional golf bag, generally comprises a bag body, a tilting device and a support bracket. The tilting device includes a fixed leg and steel wires extending from its top. The fixed leg has a support foot at its bottom end, the support foot can move relative to the bag body. The support bracket connects with the bag body and the steel wires by a plurality of pivots. Because of the setting of the support foot, a chamfer accordingly forms at the bottom of the bag body to ensure that the support foot can move freely. Thus, the golf bag keeps stable through the support foot and the base of the bag body when the golf bag is vertically placed; when the golf bag is placed slantways, the fixed leg moves upwards to push the steel wires to unfold the support bracket. At the time, the golf bag keeps balance by the support foot and the support bracket.

However, firstly, because the golf bag has a chamfer formed at the bottom of the bag body, so its appearance has not a feeling of whole. Secondly, the golf bag can not keep stable when it is placed vertically or slantways for the following reasons: 1. Because the bag body of the golf bag has a chamfer formed at its bottom, so the area of the base of the bag body become smaller, and the contacting area of the bag body with the ground also becomes smaller so that the golf bag can not keep a very stable status; 2. In addition, the golf bag is even unstable when placed slantways because there is only a plurality of point thereon contacting with the ground.

Hence it is desired to provide a golf bag which can overcome the foregoing drawbacks of the prior art.

SUMMARY OF THE INVENTION

A main object of the present invention is to provide a golf bag with a good appearance which is very stable when positioned vertically and slantways.

To achieve the above-mentioned object, a golf bag of the present invention comprises a bag body, a tilting device, and a support. The bag body has an inner storage rack which comprises a top frame, a lower frame, a base frame, a plurality of frame rods provided between the top frame and the lower frame and a joint block for stably coupling the lower frame and the base frame. The tilting device comprises a tilt control body and a pair of steel wires extending therefrom, the tilt control body having a release shank therein, a notch and a retainer formed in the upper portion thereof, a protrusion formed on the upper portion of the release shank and a control foot formed at the lower portion thereof to push the release shank to move up and down relative to the tilt control body. The lower frame has an engaging body which can disengage with the retainer through the push of the release shank.

In the present invention, the base frame has a flat bottom surface and the control foot is a distance above the bottom surface of the base frame. The engaging body comprises an retainer projection on an upper portion and a release projection on a lower portion, and the engaging body clasps the retainer by the retainer projection thereof. The retainer projection of the engaging body is released from the retainer by using the release shank to push the bottom edge.

For the purpose of making the invention easier to understand, one particular embodiment thereof will now be described with reference to the appended drawings in which:

DETAILED DESCRIPTION OF THE INVENTION

Figure 1:
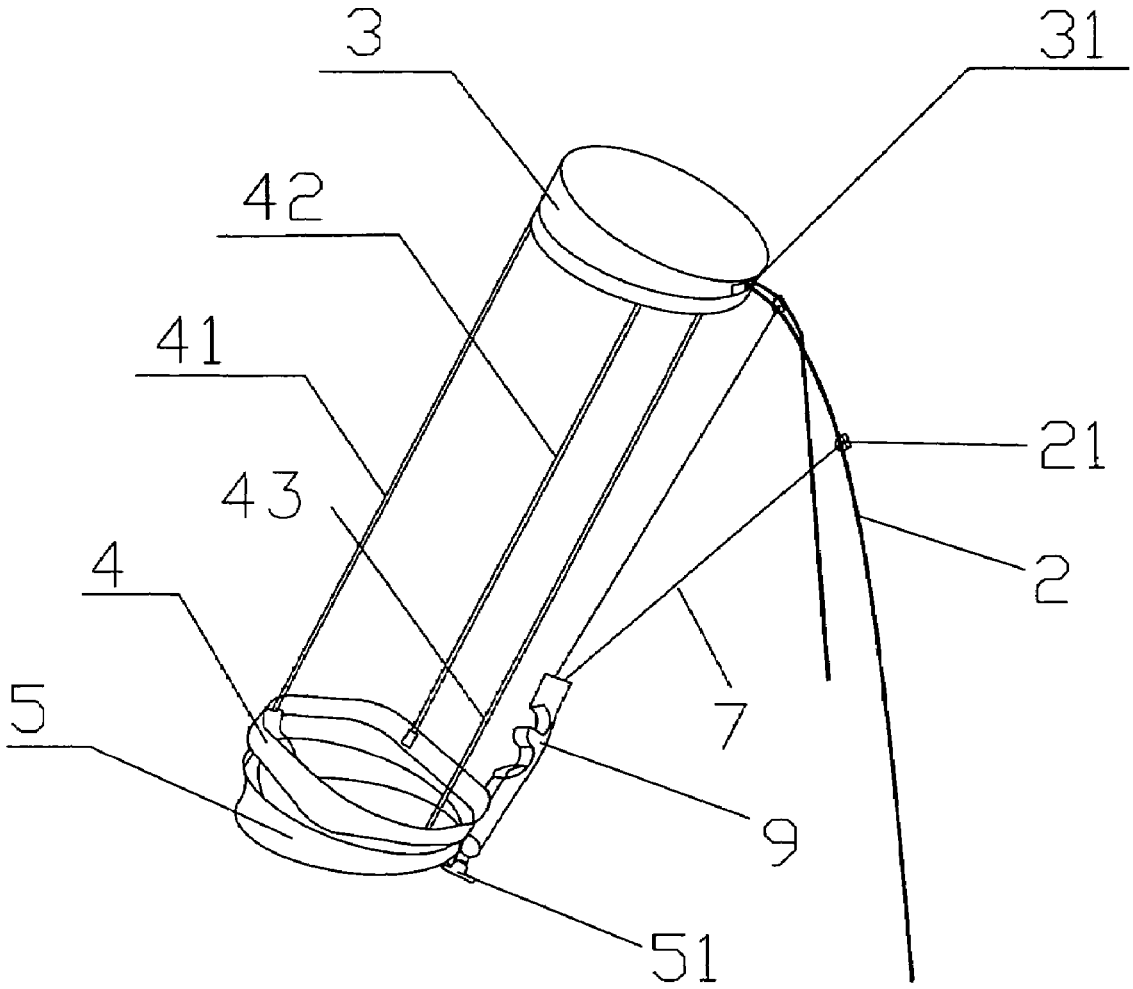
FIG. 1 is a schematic, perspective view of a golf bag of the present invention which is positioned slantways.
Figure 3:
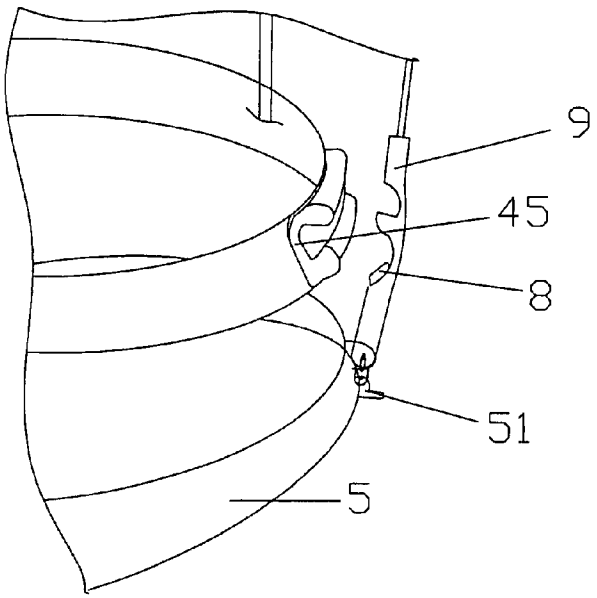
FIG. 3 is a partial, enlarged view of the golf bag during it is positioned slantways.
Figure 2:
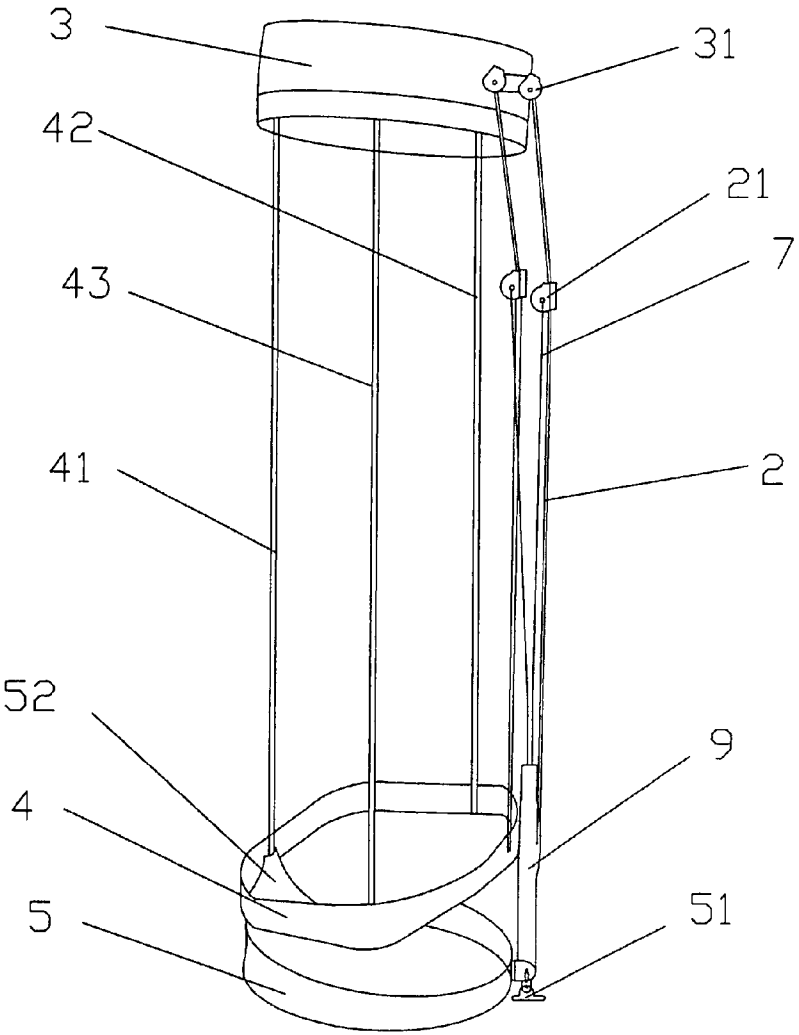
FIG. 2 is a schematic, perspective view of the golf bag of FIG. 1 which is positioned vertically.

Referring now to the drawings in detail, FIGS. 1-3 show a golf bag according to an embodiment of the present invention. The golf bag comprises a bag body, a support 2, and a tilting device. The bag body comprises an inner storage rack and an outer wrappage (not shown) to enclose the storage rack. The storage rack comprises a top frame 3, a lower frame 4, a base frame 5, frame rods 41, 42, 43 provided between the top frame 3 and the lower frame 4, and a joint block 52 for stably coupling the lower frame 4 with the base frame 5. The top frame 3 is provided with a first pivot 31 and the base frame 5 has a flat bottom surface.

Figure 4:
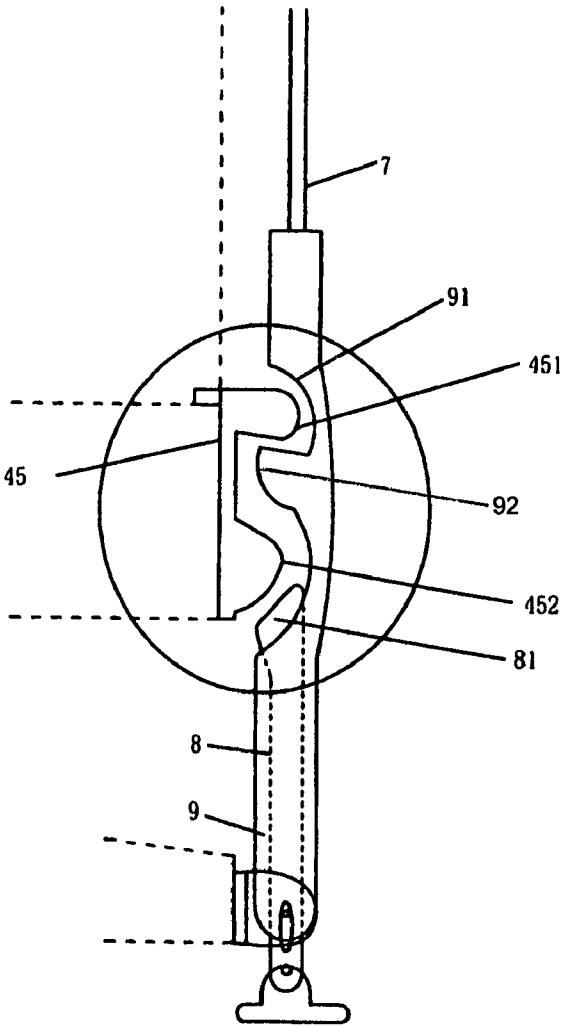
FIG. 4 is a schematic view showing a relationship of a moveable shank with a Σ-shaped frame of the golf bag during it is positioned vertically.
Figure 5:
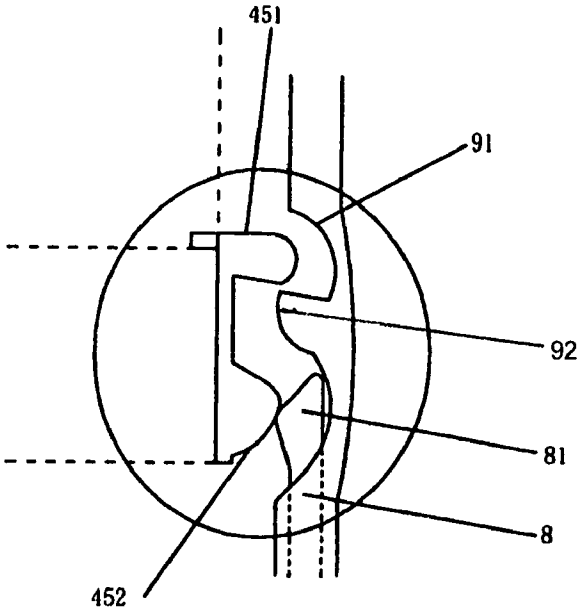
FIG. 5 is a schematic view showing a relationship of a moveable shank with a Σ-shaped frame of the golf bag during it is positioned slantways.

The tilting device comprises a tilt control body 9 and a pair of steel wires 7 extending therefrom. Referring to FIGS. 4-5, the tilt control body 9 has a passage in a lower portion with a release shank 8 disposed therein, and a notch 91 and a retainer 92 are formed in an inner side of the tilt control body 9. The release shank 8 also has a control foot 51 at a bottom thereof, and the control foot 51 can push the release shank 8 to move up and down relative to the tilt control body 9. In the present invention, the base frame 5 is pivotably connected with the tilt control body 9, and there is a distance from the control foot 51 to a bottom surface of the base frame 5. The lower frame 4 includes an engaging body 45 on a side thereof bordering upon the tilt control body 9, and the engaging body 45 has an retainer projection 451 and an release projection 452.

The support bracket 2 is provided with two feet, the two feet are linked with the top frame 3 by a first pivot 31. Each of the two feet has a second pivot 21 in middle thereof, and through the second pivots 21 the steel wires 7 connect with the support bracket 2.

In the present invention, when the golf bag is placed vertically, it can stand stably without the help of the support 2 because the bottom surface of the base frame 5 is flat. At the time, the control foot 51 is suspended above the ground and the retainer projection 451 of the engaging body 45 is held by the retainer 92.

Referring to FIGS. 4-5, when the golf bag of the present invention is desired to be tilted with the help of the support 2, it only needs to tilt the bag body towards the direction of the control foot 51 until the control foot 51 contacts with the ground. After the control foot 51 contacts with the ground, it will push the release shank 8 to move upwards relative to the tilt control body 9 until a protrusion 81 of the release shank 8 contacts and subsequently pushes the release projection 452 of the engaging body 45, then under the push of the protrusion 81 the release projection 452 drives the tilt control body 9 to move outwards relative to the engaging body 45, until the retainer projection 451 is released from the retainer 92. Thus, the tilt control body 9 disengages with the engaging body 45, and then the engaging body 45 slides downwards until the engaging body 45 and the base frame 5 overlap because the engaging body 45 has nothing to support its bottom. At the same time, the tilt control body 9 is tilted along with the bag body to push the steel wires 7 to unfold the support 2.

when recovering the golf bag to a vertical position, it is only required to tilt the bag body towards the opposite side of the control foot 51, then the lower frame 4 drives the engaging body 45 to move upwards. Simultaneously, the tilt control body 9 is turned to the vertical direction and draws the steel wires 7 to pull the support 2 to fold. And last, the retainer projection 451 of the engaging body 45 is held by the retainer 92 again and the support 2 is folded to its original position.

Compared with the prior art, first, the golf bag of the present invention has no chamfer at the bottom of the bag body, so its appearance gives audience a feeling of whole, and the bottom of the bag body has a bigger area than that of the traditional golf bag. Secondly, when the golf bag is vertically placed, the contact area with the ground becomes bigger because the bottom area of the bag body becomes bigger, so the golf bag will be more steady when placed; when the golf bag is placed slantways, it is more stable when placed because the whole bottom surface of bag body and the support 2 both contact with the ground. In addition, because the position of the top frame 3 and the lower frame 4 is relatively changeless, so the outer wrappage therebetween can be crease-resistant; when the golf bag is tilted, because change only happens at the distance between one end of the lower frame 4 and the base frame 5, so the wrinkle of the outer wrappage is all collected in the tiny space between the lower frame 4 and the base frame 5, and this wrinkle can be concealed by mounted a decorative cover on the outer wrappage so as to improve the appearance of the golf bag when it is tilted.

It is understood that the invention may be embodied in other forms without departing from the spirit thereof. Thus, the present example and embodiment are to be considered in all respects as illustrative and not restrictive, and the invention is not to be limited to the details given herein.

What is claimed is:

1. A golf bag comprises:

a bag body adapted to tilt in a forward direction with a front side and a back side opposite, having an inner storage rack which comprises a top frame, a lower frame connected to the top frame by a plurality of frame rods, an engaging body with an upper portion and a lower portion, the engaging body having a retainer projection extending outward from the lower frame of the bag body and a release projection extending outward from the lower frame of the bag body, a base frame, which contacts with the ground under the bag, and a joint block for stably coupling the lower frame and the base frame at the back side of the bag body;

a tilting device, pivotably connected to an exterior front side of the base frame comprising a tilt control body having a notch and a retainer formed in an upper portion, a passage formed interior of a lower portion, a pair of steel wires extending upward from said upper portion, a moveable release shank, disposed interior of the passage in said lower portion of said tilt control body, and having a control foot at a lower portion thereof to push the release shank to move up and down relative to the tilt control body; and a support, having an upper portion attached to an exterior front side of the top frame by a first pivot, a middle portion attached to an upper end of each of the pair of steel wires, and a lower portion for contacting the ground to support the bag body in a tilted position;

wherein when the bag body is in an upright position the tilt control body engages with the engaging body to support the front side of the golf bag in the upright position, and when the top of the bag body is tilted toward the front side, the control foot contacts a ground surface and pushes the release shank upward, causing the tilt control body to disengage from the engaging body thereby deploying said support to stabilize the golf bag in a tilted position; and wherein the base frame remains in full contact with the ground, both when the bag body is in the upright position and when the bag body is in a tilted position.

2. The golf bag as claimed in claim 1, wherein the base frame has a flat bottom surface and the control foot is a distance above a bottom surface of the base frame.

3. The golf bag as claimed in claim 2, wherein the retainer projection is positioned on an upper portion of the engaging body and the release projection is positioned on a lower portion of the engaging body with a space in a middle portion of the engaging body to accommodate the retainer of the tilt control body, and the retainer projection of the engaging body clasps the retainer of the tilt control body.

4. The golf bag as claimed in claim 3, wherein the retainer of the tilt control body is released from the retainer projection of the engaging body when a protrusion on the release shank is pushed against the release projection of the engaging body.

5. A golf bag comprising:

a bag body adapted to tilt in a forward direction with a front side and a back side opposite, having an inner storage rack which comprises a top frame, a lower frame connected to the top frame by a plurality of frame rods, an engaging body with an upper portion and a lower portion, the engaging body having a retainer projection extending outward from the lower frame of the bag body and a release projection extending outward from the lower frame of the bag body, a base frame, which contacts with the ground under the bag, and a joint block for stably coupling the lower frame and the base frame at the back side of the bag body;

a tilting device, pivotably connected to an exterior front side of the base frame comprising a tilt control body having a notch and a retainer, formed in an upper portion, a passage formed interior of a lower portion, a pair of steel wires extending upward from said upper portion, a moveable release shank, disposed interior of the passage in said lower portion of said tilt control body, and having a control foot at a lower portion thereof to push the release shank to move up and down relative to the tilt control body; and a support, having an upper portion attached to an exterior front side of the upper frame by a first pivot, a middle portion attached to an upper end of each of the pair of steel wires, and a lower portion for contacting the ground to support the bag body in a tilted position;

wherein when the bag body is in an upright position the tilt control body engages with the engaging body to support the front side of the golf bag in the upright position, and when the top of the bag body is tilted toward the front side, the control foot contacts aground surface and pushes the release shank upward, causing the tilt control body to disengage from the engaging body thereby deploying said support to stabilize the golf bag in a tilted position; the base frame remains in full contact with the ground, both when the bag body is in the upright position and when the bag body is in a tilted position; the base frame has a flat bottom surface and the control foot is a distance above a bottom surface of the base frame; the engaging body comprises an retainer projection on an upper portion and a release projection on a lower portion with a space in a middle portion to accommodate the retainer of the tilt control body, and the retainer projection of the engaging body clasps the retainer of the tilt control body; the retainer of the tilt control body is released from the retainer projection of the engaging body when a protrusion on the release shank is pushed against the release projection of the engaging body; and wherein the top frame has a first pivot, and the support is provided with feet, and is linked with the top frame by the first pivot.

6. The golf bag as claimed in claim 5, wherein the support has two feet each having a second pivot in a middle portion thereof, and through the second pivots the steel wires connect with the support.

7. The golf bag as claimed in claim 5, wherein the base frame is pivotably connected with the tilt control body, and the engaging body and the retainer are nestingly positioned face to face.

* * * * *